United States Patent [19]

Shibukawa

[11] Patent Number: 4,953,438

[45] Date of Patent: Sep. 4, 1990

[54] AUTOMATIC PERFORMANCE APPARATUS STORING AND EDITING PERFORMANCE INFORMATION

[75] Inventor: Takeo Shibukawa, Hamamatsu, Japan

[73] Assignee: Yamaha Corporation, Hamamatsu, Japan

[21] Appl. No.: 152,025

[22] Filed: Feb. 3, 1988

[30] Foreign Application Priority Data

Feb. 6, 1987 [JP] Japan ..... 62-25682

[51] Int. Cl.[5] ..... G10H 7/00

[52] U.S. Cl. ..... 84/609; 84/649

[58] Field of Search ..... 84/1.01, 1.03, 1.28, 84/DIG. 29, 609–614, 649–652; 364/192; 381/51; 360/88, 90

[56] References Cited

U.S. PATENT DOCUMENTS 4,089,246 5/1978 Kooker ..... 84/1.03 X
4,202,235 5/1980 Namiki et al. ..... 84/1.01
4,350,070 9/1982 Bahu ..... 84/1.03
4,396,958 8/1983 Himeno et al. ..... 360/90 X
4,404,606 9/1983 Watanabe ..... 360/90 X
4,622,879 11/1986 Matsubara ..... 84/1.03

*Primary Examiner*—Stanley J. Witkowski
*Attorney, Agent, or Firm*—Spensley Horn Jubas & Lubitz

[57] ABSTRACT

An automatic performance apparatus includes a memory device, an input device, a write device, a switching device, and a write control device. The memory device stores performance information. The input device inputs the performance information. The write device sequentially writes the performance information at predetermined addresses of the memory device on the basis of an operation of the input device. The switching device commands rewriting. In response to a command from the switching device, the write control device returns a write address of the memory device to an immediately preceding start point of a predetermined music composition unit having two or more notes, thereby enabling an easy and accurate edit of the once stored performance information.

6 Claims, 12 Drawing Sheets

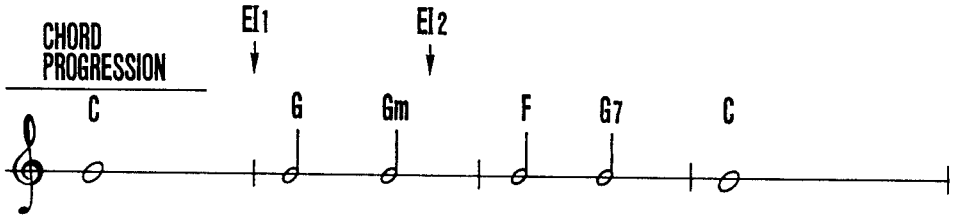
FIG.3(A)
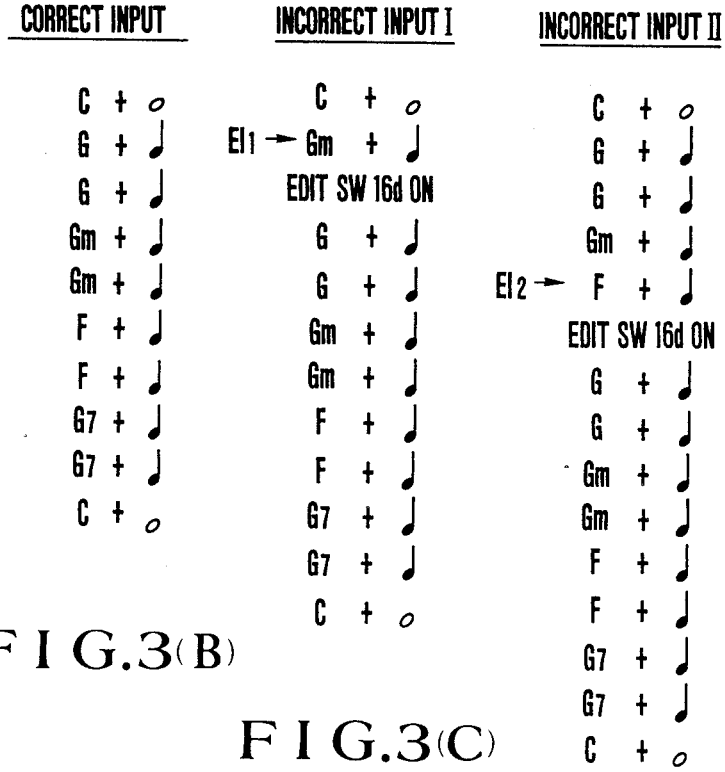
FIG.3(B)
FIG.3(C)
FIG.3(D)

AUTOMATIC PERFORMANCE APPARATUS STORING AND EDITING PERFORMANCE INFORMATION

BACKGROUND OF THE INVENTION

The present invention relates to an automatic performance apparatus and, more particularly, to an improvement in a performance information input/memory section A conventional example of an automatic performance apparatus stores performance information such as a pitch and a tone duration based on an operation of an input operating member such as a key in a memory and generates a musical tone on the basis of the performance information stored in the memory.

In some automatic performance apparatuses of this type, a read-back switch is provided for correcting inputted information so that each time the read-back switch is pushed on, the performance information is read out for one tone after another and converted into sounds in an order opposite to the inputted order, thereby searching performance information to be corrected. This searched performance information is corrected by, e.g., rewriting into the memory.

However, according to a conventional performance information correcting means as described above, if, for example, a plurality of tones having the same pitch continue, it is often difficult to determine performance information corresponding to a tone to be corrected. Therefore, it is difficult to accurately perform a correction operation.

In addition, a generated tone must be aurally perceived and examined each time the read-back switch is operated, resulting in a troublesome searching operation.

SUMMARY OF THE INVENTION

It is, therefore, a principal object of the present invention to provide an automatic performance apparatus in which a correction operation can be accurately performed.

It is another object of the present invention to provide an automatic performance apparatus in which a searching operation can be easily performed.

In order to achieve the above objects of the present invention, there is provided an automatic performance apparatus comprising a memory device having a plurality of addresses for storing music performance information composed of plural performance units (performance section, musical unit, music unit of a certain length of segment) of certain lengths each having not less than two notes, input means for inputting the music performance information, write means for sequentially writing the music performance information at the addresses of the memory device on the basis of an operation of the input means, switching means for commanding rewriting return, and write control means, responsive to a command from the switching means, for returning a write address of the memory device to a start point of a predetermined music performance unit.

According to an arrangement of the present invention, when a performer notices an incorrect input and command rewriting (address return) by the switching means, the write address is returned to, e.g., the head of a measure, so that the performer can execute an input operation again. Therefore, no troublesome searching operation need be executed, and performance information to be corrected can be easily found, so that the performer can easily and smoothly correct an incorrect input.

In general, when a musical instrument performer makes a mistake during performance, he or she habitually restarts from the head of a measure or musical phrase. Therefore, the performance information correcting means of the present invention is suitable for such a habit and hence can be used very easily.

BRIEF DESCRIPTION OF THE DRAWINGS

FIGS. 3(A) to 3(D) are views for briefly explaining an input operation;

DETAILED DESCRIPTION OF THE PREFERRED EMBODIMENTS

Figure 1:
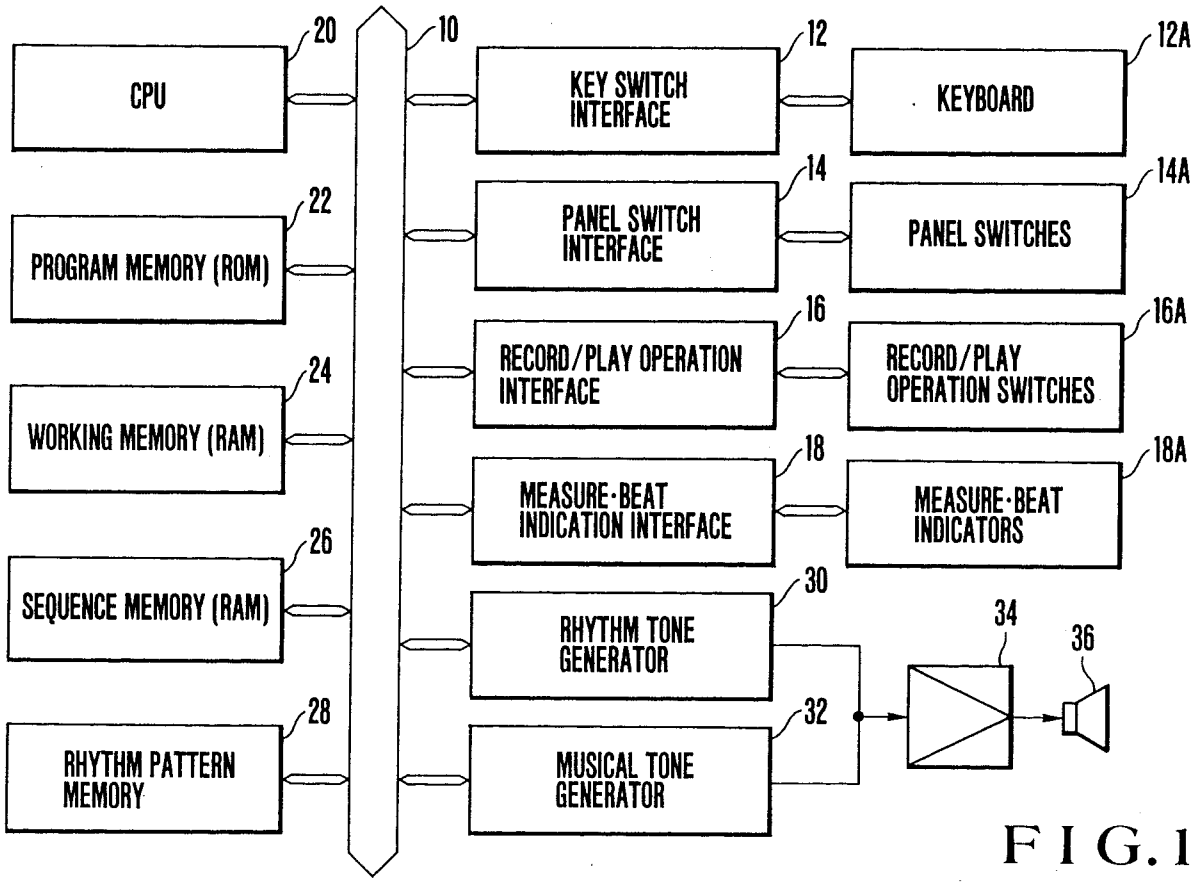
FIG. 1 is a block diagram of a circuit arrangement of an electronic musical instrument having an automatic performance apparatus according to an embodiment of the present invention.

FIG. 1 shows a circuit arrangement of an electronic musical instrument having an automatic performance apparatus according to an embodiment of the present invention. In the electronic musical instrument of this embodiment, generation of a manual performance tone, generation of an automatic rhythm tone, record/play (generation of an automatic chord tone) of chord information, and the like are controlled by a microcomputer.

Circuit Arrangement (FIG. 1)

A keyboard 12A, panel switches 14A, record/play operation switches 16A, and measure beat indicators 18A are connected to a bus 10 through a key switch interface 12, a panel switch interface 14, a record/play operation interface 16, and a measure beat indication interface 18.

A central processing unit (CPU) 20, a program memory 22 consisting of a ROM (Read-Only Memory), a working memory 24 consisting of a RAM (Random Access Memory), a sequence memory 26 consisting of a RAM, a rhythm pattern memory 28 consisting of a ROM or RAM, a rhythm tone generator 30, a musical tone generator 32, and the like are also connected to the bus 10.

The keyboard 12A has a large number of keys for driving corresponding key switches. Key operation information of each key is detected through the key switch interface 12.

The panel switches 14A include panel switches such as a tone color selection switch, a volume set switch, a rhythm set switch, and the like other than switches included in the record/play operation switches 16A. Switch operation information of each switch is detected through the panel switch interface 14.

The record/play operation switches 16A include, for example, a switch and an indicator for recording/playing chord information and will be described later in detail with reference to FIG. 2.

The measure beat indicators 18A indicate a measure and a beat when the chord information is to be input and will be described in detail later with reference to FIG. 2.

The CPU 20 executes processing for generating various musical tones, recording/playing, and the like in accordance with programs stored in the program memory 22. The above processing will be described in detail later with reference to FIGS. 6 to 13.

The working memory 24 includes a large number of memory areas used as, e.g., registers and flags when the CPU 20 executes the various processing. The registers and the like used to practice the present invention will be described later.

In a record mode, panel information, chord information, and the like are written in the sequence memory 26. In a play mode, an automatic rhythm and an automatic chord are performed on the basis of the memory information of the memory 26. A memory data format of the memory 26 will be described later with reference to FIG. 5.

The rhythm pattern memory 28 stores rhythm patterns in units of rhythms such as a march, a waltz, an 8-beat, and the like. In the play mode, the automatic rhythm is performed in accordance with a selected rhythm pattern in the memory 28.

The rhythm tone generator 30 generates a rhythm tone signal in accordance with readout data from the memory 28.

The musical tone generator 32 generates a musical tone signal (manual performance tone signal) according to a performance operation of the keyboard 12A, a chord tone signal (automatic chord tone signal) according to the readout data from the memory 28, and the like.

The rhythm tone signal from the rhythm tone generator 30 and the musical tone signal from the musical tone generator 32 are supplied to a loudspeaker 36 through an output amplifier 34 and converted into a sound.

Figure 2:
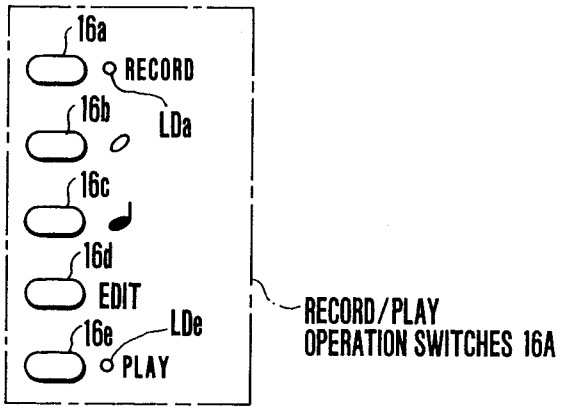
FIG. 2 is a plan view of an arrangement of record/-play switches and indicators in the electronic musical instrument.

Record/Play Switch Indicator Arrangement (FIG. 2)

FIG. 2 shows the record/play operation switches 16A and the measure beat indicators 18A.

The record/play operation switches 16A include a record switch **16*a*, a whole note switch 16*b*, a quarter note switch 16*c*, an edit switch 16*d*, and a play switch 16*e*. A record indicator LDa and a play indicator LDe are provided to the right of the record switch 16*a* and the play switch 16*e***, respectively. Each of the indicators LDa and LDe consists of, e.g., a light-emitting diode.

When the record switch **16*a* is turned on, the record mode is set, and the record indicator LDa is turned on. When the play switch 16*e*** is turned on, the play mode is set, and the play indicator LDe is turned on.

In the record mode, when a given key of the keyboard 12A is depressed and the whole note switch **16*b*, is turned on, a tone generation interval corresponding to a whole note can be designated for a musical tone corresponding to the depressed key. In this case, if no key is depressed, a rest interval corresponding to a whole rest can be designated. Similarly, the quarter note switch 16*c* can designate a tone generation interval corresponding to a quarter note or a rest interval corresponding to a quarter rest. Note that in order to designate a tone generation interval corresponding to a half note or a rest interval corresponding to a half rest, the quarter note switch 16*c*** is turned on twice.

The edit switch **16*d* is operated so as to reinput when an incorrect input occurs in the record mode. When the switch 16*d*** is turned on, a reinput operation can be started from the head of a measure.

The measure beat indicators 18A include a beat indicator **18*a*** which is obtained by arranging four light-emitting elements L1 to L4 in a transverse direction and a measure indicator consisting of a 7-segment indicator of three digits.

In the record mode, the measure indicator **18*b* indicates a measure currently being input by a measure number, and the beat indicator 18*a* indicates an input number of a beat by light emission of one of L1 to L4. In the play mode, the measure indicator 18*b* is used as a tempo indicator for indicating a tempo of a rhythm by the number of quarter notes per minute such as "120". In this case, the light-emitting elements L1 to L4 of the beat indicator 18*a*** sequentially emit light in synchronism with the rhythm tempo, thereby indicating beat progression.

Brief Description of Input Operation (FIGS. 3(A) to 3(D))

FIGS. 3(A) to 3(D) briefly explain an input operation, in which FIG. 3(A) shows chord progression, FIG. 3(B) shows correct input, FIG. 3(C) shows a first example of incorrect input, and FIG. 3(D) shows a second example of incorrect input.

Assume that chord information is to be input in accordance with the chord progression of FIG. 3(A). In this case, since a chord C (C major) is a whole note, the whole note switch **16*b*, is turned on once while designating the chord C by the keyboard 12A. Since a chord G is a half note, the quarter note switch 16*c*** is turned on twice while designating the chord G. Similarly, chords from a chord Gm are input.

In this case, if the chord Gm is designated and the switch **16*c* is turned on at a position EI1 where the chord G is to be designated as shown in FIG. 3(C), the edit switch 16*d* is turned on. As a result, a reinput operation can be started from the head of the second measure. Therefore, the chord G is designated and the switch 16*c*** is turned on twice, and then the chords from the chord G are input.

If a chord F is designated and the switch **16*c* is turned on at a position EI2 where the chord Gm is to be designated as shown in FIG. 3(D), the edit switch 16*d*** is turned on to return to the head of the second measure, and then the chords are reinput therefrom.

In the above description, incorrect chord designation is exemplified. However, when the note switch is incorrectly operated, the edit switch **16*d*** is similarly turned on to return to the head of the measure, thereby performing the reinput operation.

Figure 4:
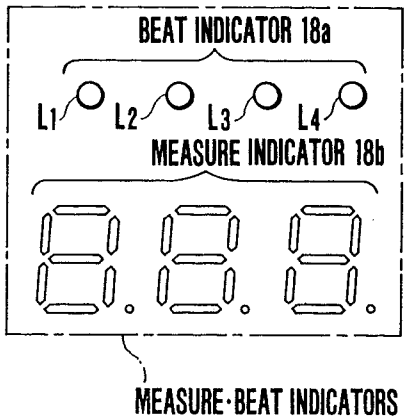
FIG. 4 is a timing chart of a record/play timing of one measure.
Figure 4:
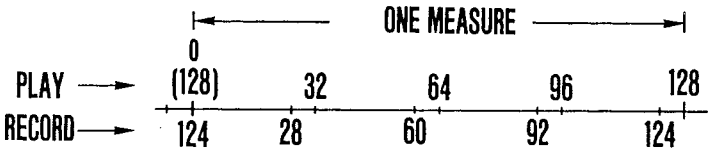

Record/Play Timing of One Measure (FIG. 4)

FIG. 4 shows record and play timings of one measure. In this embodiment, one measure is divided into 128 sections, and a beat interval corresponds to 32 sections assuming that one measure includes four beats.

In the play mode, the head (first beat) of the measure corresponds to 0 (or 128); the second beat, 32; the third beat, 64; and the fourth beat, 96. In the record mode, a timing is designated for each beat by the number smaller than a timing value in the play mode by four. That is, the first, second, third, and fourth beats correspond to 124, 28, 60, and 92, respectively.

Figure 5:
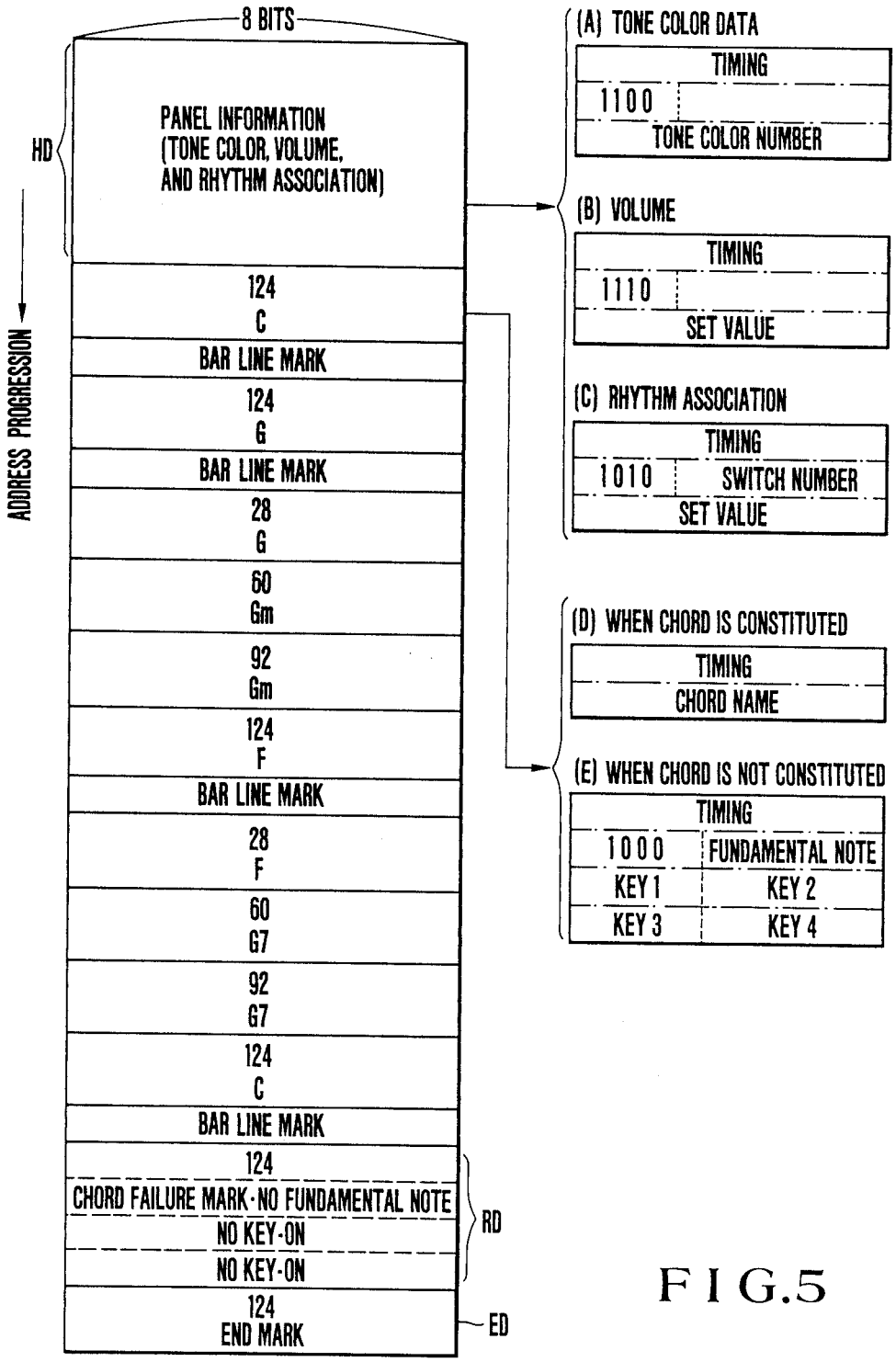
FIG. 5 is a view of a memory data format of a memory 26.

Memory Data Format of Memory 26 (FIG. 5)

FIG. 5 shows a memory data format of the memory 26 in which panel information associated with a chord tone color, a chord volume, and an automatic rhythm as shown in data maps (A) to (C) are stored as head data HD.

Chord tone color data of the data map (A) is 3-byte data in which the first byte represents that timing value=124, the upper four bits of the second byte represent a data type, and the third byte represents a tone color number, respectively.

Chord volume data of the data map (B) is 3-byte data in which the first byte represents that timing value=124, the upper four bits of the second byte represent a data type, and the third byte represents a set value of a chord volume, respectively.

Automatic rhythm association data of the data map (C) is 3-byte data in which the first byte represents that timing value=124, the upper four bits of the second byte represent a data type, the lower four bits of the second byte represent a switch number of a rhythm associated switch, and the third byte represents a set value of the switch. The rhythm associated switches include a tempo set switch (switch number SNO=0), a variation pattern selection switch (SNO=1), a rhythm volume set switch (SNO=2), and a rhythm selection switch (SNO=3), and the data of the data map (C) are stored in correspondence to these switches.

Input data are stored subsequently to the head data HD in the order they were input. The input data are those shown in a data map (D) when a chord is constituted or established and are those shown in a data map (E) when a chord is not constituted or failed.

The data of the data map (D) is 2-byte data in which the first byte represents a timing value (124, 28, 60, or 92) and the second byte represents a chord name, respectively. Chord name data of the second byte takes a value of "00" to "7F" in hexadecimal notation.

The data of the data map (E) is 4-byte data in which the first byte represents a timing value (124, 28, 60, or 92), the upper four bits of the second byte represent a data type (chord failure mark), the lower four bits of the second byte represent a fundamental note, the third byte represents two keys at the high pitch side of depressed keys, and the fourth byte represents two keys at the high pitch side next to the keys represented by the third byte, respectively.

A data format of the data map (E) is also used in rest designation wherein the note switch 16*b*, or 16*c* is turned on without a key-on operation of the keyboard 12A. In this case, the lower four bits (fundamental note) of the second byte are set to "F" in hexadecimal notation, thereby representing that no fundamental note is present. Each key data of four keys of the third and fourth bytes is set to "E" in hexadecimal notation, thereby representing that no key-on operation is performed.

FIG. 5 shows a memory state of input data based on correct input of FIG. 3(B). A sound generation timing of input data having a timing value of 124 corresponds to the head of a measure, and a bar line mark of one byte is stored subsequent to the input data. In the score shown in FIG. 3(A), the bar line is arranged at the head of a measure. However, in the memory data format of this embodiment, the bar line mark data is arranged next to the head note of a measure. For this reason, in the edit processing, the bar line mark can be easily searched by checking data in an order opposite to that they were stored.

At the end of the input data, rest designation data RD of the format similar to the data of the above data map (E) is stored and then end data ED is stored. In the rest designation data RD, the first byte represents that timing value=124, the second byte represents the chord failure mark or that no fundamental note is present, and each of the third and fourth bytes represents that no key-on operation is performed. The end data ED is 2-byte data in which the first byte represents that timing value=124 and the second byte represents the end mark.

Since the rest designation data RD and the end data ED are formatted as described above, play processing is always completed through a rest interval corresponding to a whole rest in the play mode. In this case, if last input data is either the chord name data (when a chord is constituted) or the key data (when a chord is not constituted), a musical tone corresponding to either of the data is continuously generated immediately up to the rest interval corresponding to a whole rest. For example, when the last input data is data of a chord F whose timing value=28, the chord F is continuously generated for an interval corresponding to a dotted half note and then the rest interval corresponding to a whole note begins.

Figure 6:
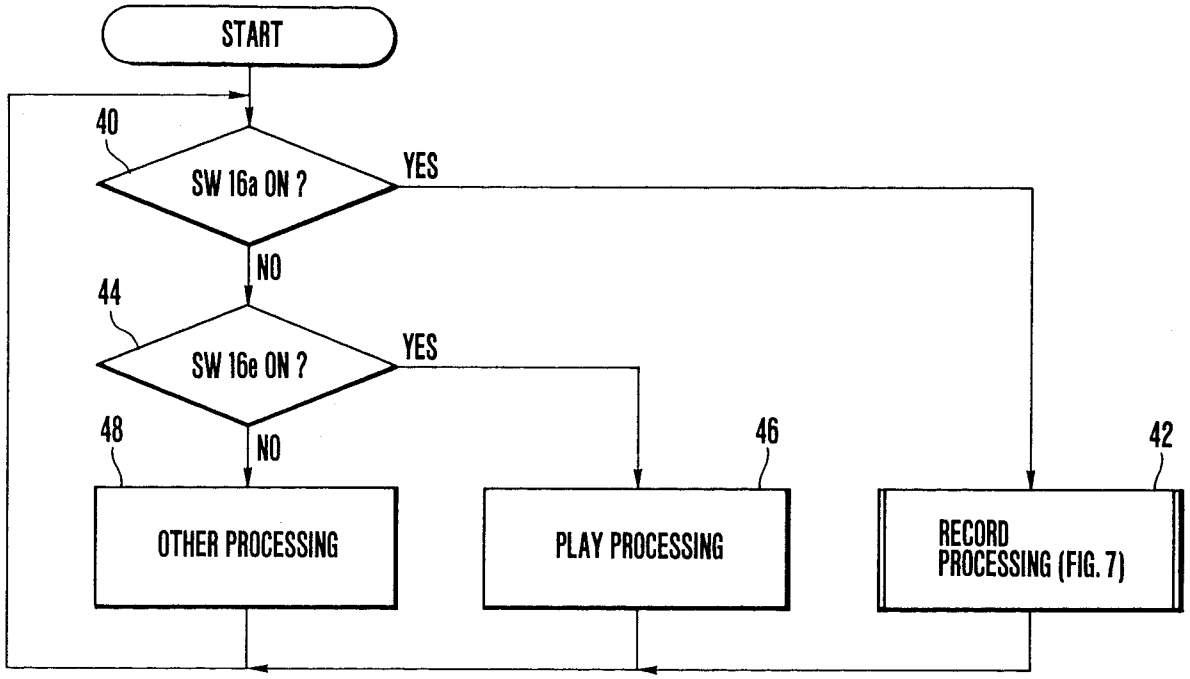
FIG. 6 is a flow chart of a main routine.

Main Routine (FIG. 6)

FIG. 6 shows a flow of main routine processing. This routine is started when the power switch is turned on.

First, in step 40, the CPU 20 checks whether the record switch 16*a* is turned on. If YES (Y) in step 40, the flow advances to step 42, and a subroutine of record processing is executed as will be described with reference to FIG. 7. Thereafter, the flow returns to step 40.

If NO (N) in step 40, the flow advances to step 44, and the CPU 20 checks whether the play switch 16*e* is turned on. If Y in step 44, the flow advances to step 46, and play processing is executed. Thereafter, the flow returns to step 40.

If N in step 44, the flow advances to step 48, and other processing is executed. Other processing includes set processing of a musical tone parameter (a tone color, a volume, an effect, and the like) based on an operation of the various panel switches, set processing of performance conditions based on a switching operation of the automatic rhythm associated switches, manual performance tone generation processing based on a key operation, and the like. After step 48, the flow returns to step 40.

Figure 7:
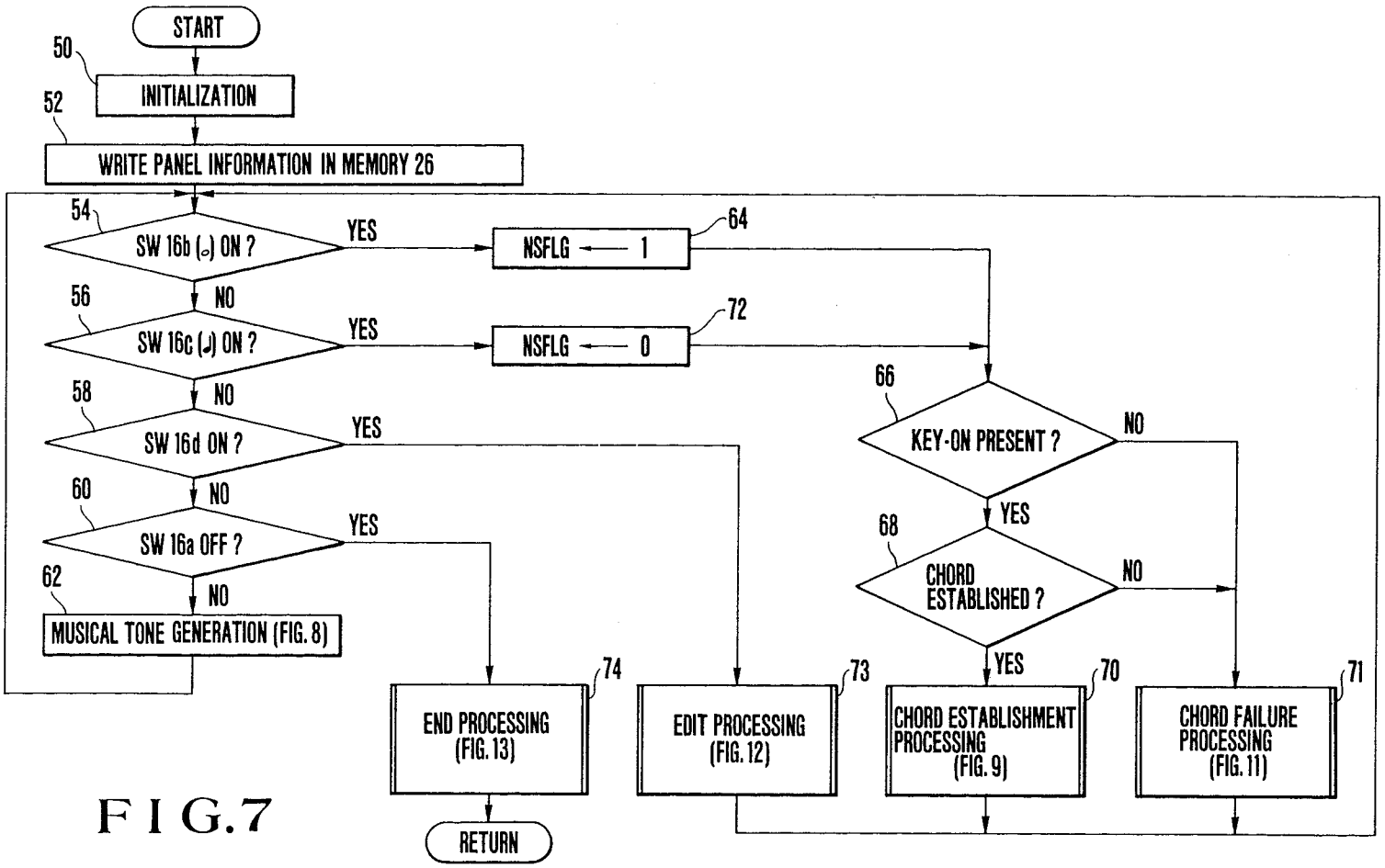
FIG. 7 is a flow chart of a subroutine of recording processing.

Subroutine of Record Processing (FIG. 7)

In a subroutine of record processing shown in FIG. 7, initialization processing is executed in step 50. That is, the record indicator LDa is turned on, and at the same time, 0, 124, 0, 0, 0, and 0 are set in an address pointer ADPNT for address designation, a timing register TMR, a note switch flag NSFLG, a note length register NLR, a key-on flag KOFlG, and a measure counter BAR, respectively. These registers, flags, and counter are included in the working memory 24.

Then, in step 52, panel information are fetched from the panel switches 14A through the panel switch interface 14 and written as the head data HD in the memory 26 while designating addresses by the pointer ADPNT, as described above with reference to FIG. 5. When write of the head data HD is completed, the pointer ADPNT designates an address next to the last write address. Thereafter, the flow advances to step 54.

In step 54, the CPU 20 checks whether the whole note switch **16*b*, is turned on. If N in step 54, the flow advances to step 56, and the CPU 20 checks whether the quarter note switch 16*c* is turned on. If N in step 56, the flow advances to step 58**.

In step 58, the CPU 20 checks whether the edit switch **16*d* is turned on. If N in step 58, the flow advances to step 60, and the CPU 20 checks whether the record switch 16*a* is turned off. If N in step 60, the flow advances to step 62**.

In step 62, a subroutine of musical tone generation is executed as will be described later with reference to FIG. 8. In this subroutine, a musical tone is generated if a key-on operation is performed on the keyboard 12A. Then, the flow returns to step 54.

When the switch **16*b*, is turned on while steps 54 to 62 are repeatedly performed, Y is obtained in step 54, and the flow advances to step 64**.

In step 64, 1 is set in the flag NSFLG. Then, the flow advances to step 66, and the CPU 20 checks whether a key-on operation is performed on the keyboard 12A. If Y in step 66, the flow advances to step 68.

In step 68, the CPU 20 checks whether a chord is constituted. This is performed to check whether a key depression state of the keyboard 12A corresponds to any of a large number of predetermined chords.

If Y in step 68, the flow advances to step 70, and a subroutine of chord establishment processing is executed as will be described later with reference to FIG. 9. Then, the flow advances to step 54.

If N in step 68 or 66, the flow advances to step 71, and a subroutine of chord failure processing is executed as will be described later with reference to FIG. 11. Then, the flow returns to step 54.

When the switch **16*c* is turned on, Y is obtained in step 56, and the flow advances to step 72. In step 72, 0 is set in the flag NSFLG, and then processing from step 66** is executed as described above.

When the switch **16*d* is turned on, Y is obtained in step 58, and the flow advances to step 73. In step 73, a subroutine of edit processing is executed as will be described with reference to FIG. 12. Then, the flow returns to step 54**.

Finally, when the switch **16*a* is turned off, Y is obtained in step 60, and the flow advances to step 74. In step 74, a subroutine of end processing is executed as will be described later with reference to FIG. 13. Thereafter, the flow returns to the routine of FIG. 6**.

Figure 8:
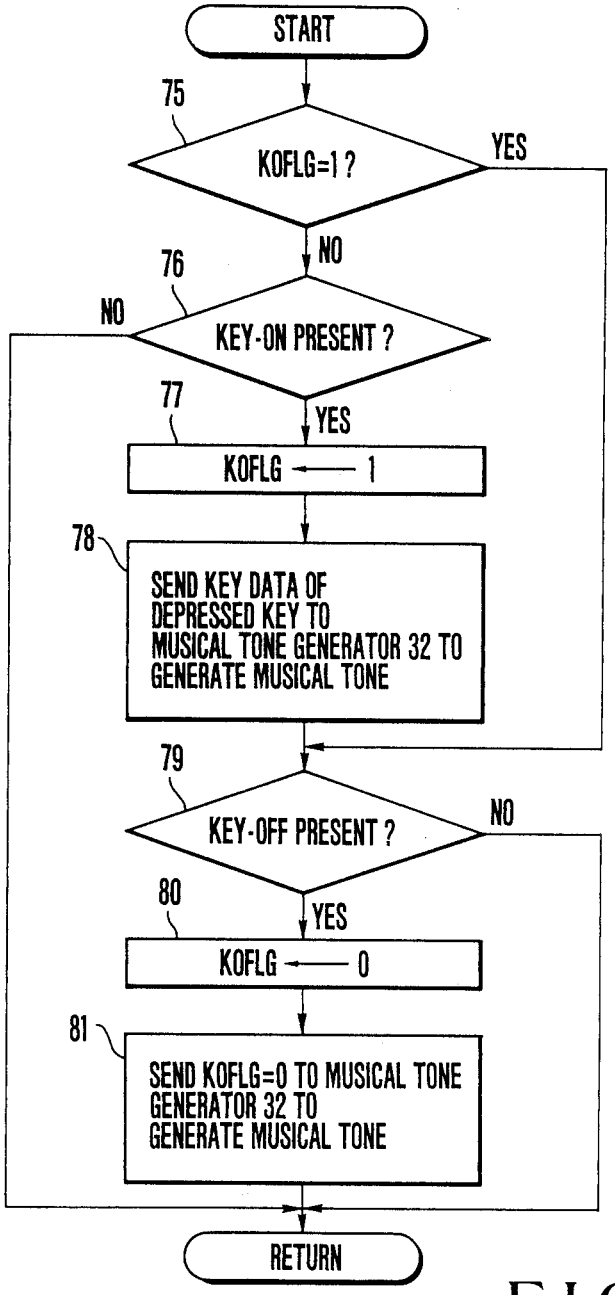
FIG. 8 is a flow chart of a subroutine of musical tone generation.

Subroutine of Musical Tone Generation (FIG. 8)

In a subroutine of musical tone generation shown in FIG. 8, the CPU 20 checks in step 75 whether the flag KOFLG is 1 (i.e., whether a musical tone is generated). If N in step 75, the flow advances to step 76, and the CPU 20 checks whether a key-on operation is performed. If N in step 76, the flow returns to the routine of FIG. 7.

If Y in step 76, the flow advances to step 77, and 1 is set in the flag KOFLG. The flow advances to step 78, and key data corresponding to a depressed key is sent to the musical tone generator 32 to generate a tone.

When processing in step 78 is completed or Y is obtained in step 75 (i.e., a musical tone is generated), the flow advances to step 79, and the CPU 20 checks whether a key-off operation is performed. If Y in step 79, 0 is set in the flag KOFLG in step 80, and then the flow advances to step 81.

In step 81, KOFLG=0 is supplied to the musical tone generator 32 to stop the tone being generated. Then, the flow returns to the routine of FIG. 7. If N in step 79, the flow also returns to the routine of FIG. 7.

Figure 9:
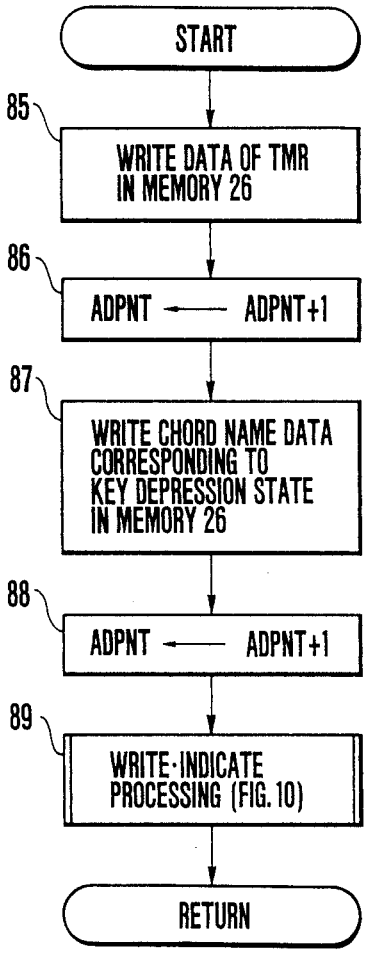
FIG. 9 is a flow chart of a subroutine of chord establishment processing.

Subroutine of Chord Establishment Processing (FIG. 9)

In a subroutine of chord establishment processing shown in FIG. 9, timing data of the register TMR is written in the memory 26 in step 85. At this time, a write address is designated by the pointer ADPNT. For example, when the flow advances to step 85 for the first time after write of the head data HD is completed, the write address is an address next to the final write address of the head data HD.

Then, a value of the pointer ADPNT is incremented by 1 in step 86, and the flow advances to step 87. In step 87, chord name data corresponding to a key depression state of the keyboard 12A is written in the memory 26.

Thereafter, the value of the pointer ADPNT is incremented by 1 in step 88, and the flow advances to step 89. In step 89, a subroutine of write indicate processing is executed as will be described later with reference to FIG. 10. Then, the flow returns to the routine of FIG. 7.

Figure 10:
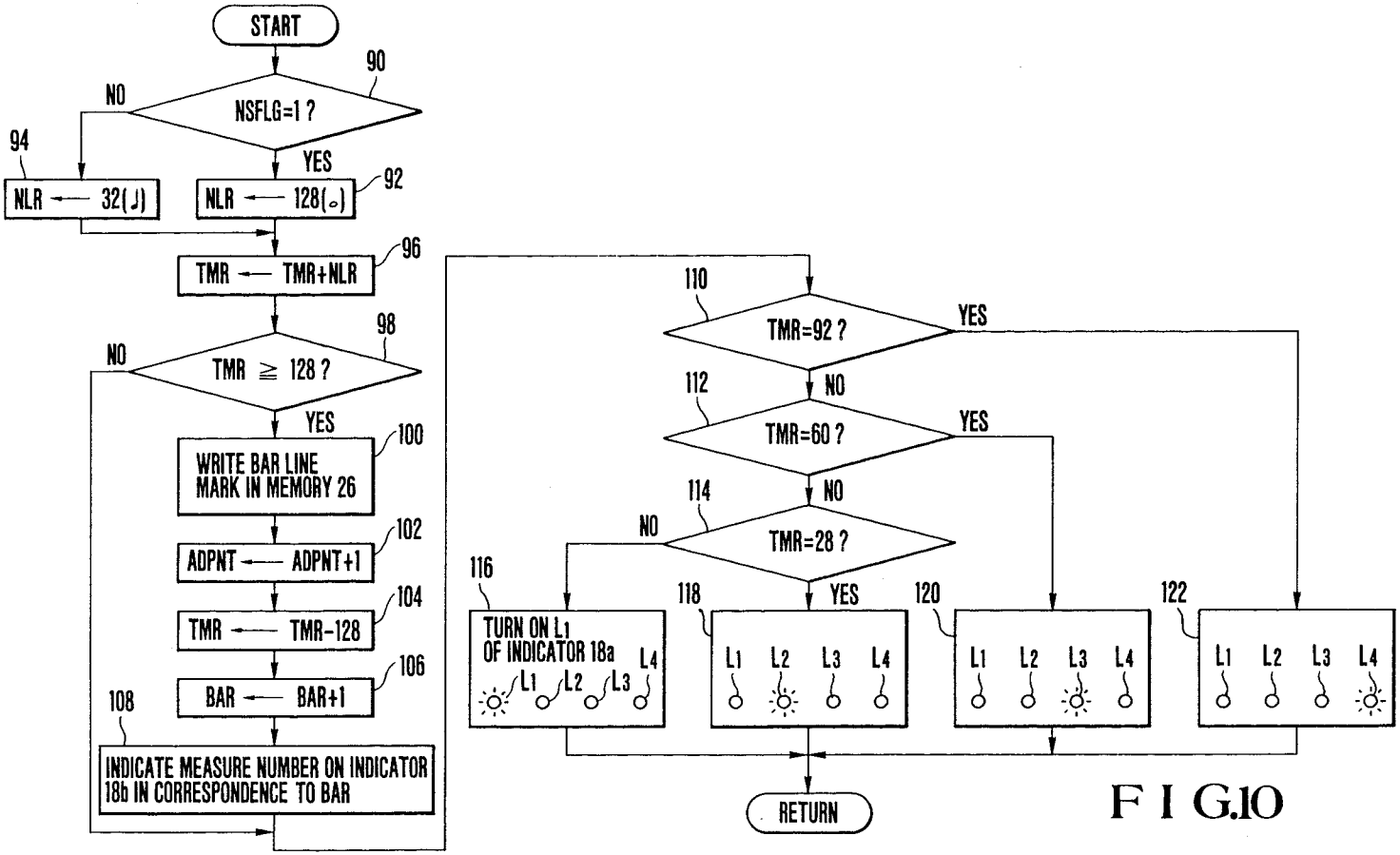
FIG. 10 is a flow chart of a subroutine of write indicate processing.

Subroutine of Write Indicate Processing (FIG. 10)

In a subroutine of write indicate processing shown in FIG. 10, the CPU 20 checks in step 90 whether the flag NSFLG is 1 (i.e., whether the whole note switch **16*b*, is turned on). If Y in step 90, the flow advances to step 92, and 128 is set in the register NLR. If N in step 90, the flow advances to step 94, and 32** (which corresponds to a length of a quarter note) is set in the register NLR.

After step 92 or 94, the flow advances to step 96, and a value obtained by adding the value of the register NLR to the value of the register TMR is set in the register TMR. Then, the flow advances to step 98.

In step 98, the CPU 20 checks whether the value of the register TMR is 128 or more (i.e., whether one measure is ended). If Y in step 98, the flow advances to step 100, and bar line mark data is written in the memory 26.

For example, when the flow advances to step 100 for the first time after the first chord C of FIG. 3(A) is written in the memory 26 in step 87 of FIG. 8, the bar line mark data is written at an address next to the data of the chord C because the value of the pointer ADPNT is incremented by 1 in step 88.

After step 100, the value of the pointer ADPNT is incremented by one in step 102, and then the flow advances to step 104. In step 104, a value obtained by subtracting 128 from the value of the register TMR is set in the register TMR. As a result, the TMR value becomes 124 if it is 124+128 immediately after step 96 and becomes 28 if it is 124+32.

Then, a value of the counter BAR is incremented by one in step 106, and the flow advances to step 108. In step 108, a measure number is indicated on the indicator **18*b*** in correspondence to the value of the counter BAR. For example, when the value of the counter BAR is 1, "2" is indicated.

When the processing in step 108 is completed or N is obtained in step 98, the flow advances to step 110, and the CPU 20 checks whether the TMR value is 92. If N in step 110, the flow advances to step 112, and the CPU 20 checks whether the TMR value is 60. If N in step 112, the flow advances to step 114, and the CPU 20 checks whether the TMR value is 28. If N in step 114, i.e., when TMR=124, the flow advances to step 116.

In step 116, the light-emitting element L1 of the indicator **18*a*** is turned on to indicate that this is the first beat.

If Y in step 114, the flow advances to step 118, and the light-emitting element L2 of the indicator **18*a*** is turned on to indicate the second beat.

If Y in step 112, the flow advances to step 120, and the light-emitting element L3 of the indicator **18*a*** is turned on to indicate the third beat.

If Y in step 110, the flow advances to step 122, and the light-emitting element L4 of the indicator **18*a*** is turned on to indicate the fourth beat.

When the processing in step 116, 118, 120, or 122 is completed, the flow returns to the routine of FIG. 9.

Figure 11:
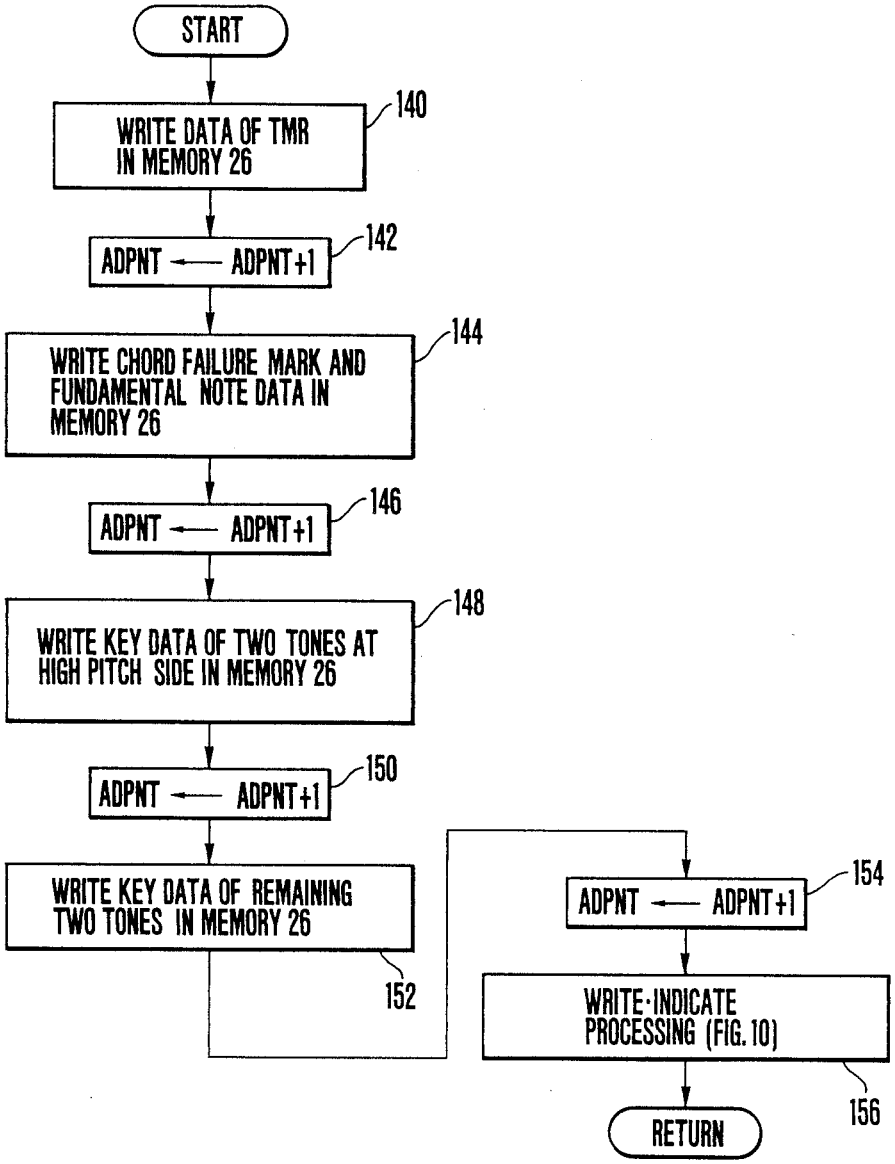
FIG. 11 is a flow chart of a subroutine of chord failure processing.

Subroutine of Chord Failure Processing (FIG. 11)

In a subroutine of chord failure processing shown in FIG. 11, timing data of the register TMR is written in the memory 26 in step 140.

Then, a value of the pointer ADPNT is incremented by one in step 142, and the flow advances to step 144. In step 144, 1-byte data consisting of chord failure mark data and fundamental tone data is written in the memory 26. In this case, if no key is depressed, data representing no fundamental tone is written as the fundamental tone data. After step 144, the flow advances to step 146.

In step 146, the value of the pointer ADPNT is incremented by one. Then, the flow advances to step 148, and 1-byte data consisting of key data of two tones at the high pitch side is written in the memory 26. In this case, if no key is depressed, data representing no key-on is written as key data of two tones. If one key is depressed, data representing no key-on is written as data of the lower four bits of the 1-byte data. After step 148, the flow advances to step 150.

In step 150, the value of the pointer ADPNT is incremented by one. Then, the flow advances to step 152, and 1-byte data consisting of key data of the remaining two tones (at the high pitch side next to the data written in step 148) is written in the memory 26. In this case, if no key is depressed, data representing no key-on is written as key data of two tones. If three keys are depressed, data representing no key-on is written as data of the lower four bits of the 1-byte data. Therefore, if no key is depressed, the 2-byte data written in steps 148 and 152 represents no key-on for four keys.

After step 152, the value of the pointer ADPNT is incremented by one in step 154. Then, the flow advances to step 156, and the subroutine of write indicate processing as described above with reference to FIG. 10 is executed. Thereafter, the flow returns to the routine of FIG. 7.

Figure 12:
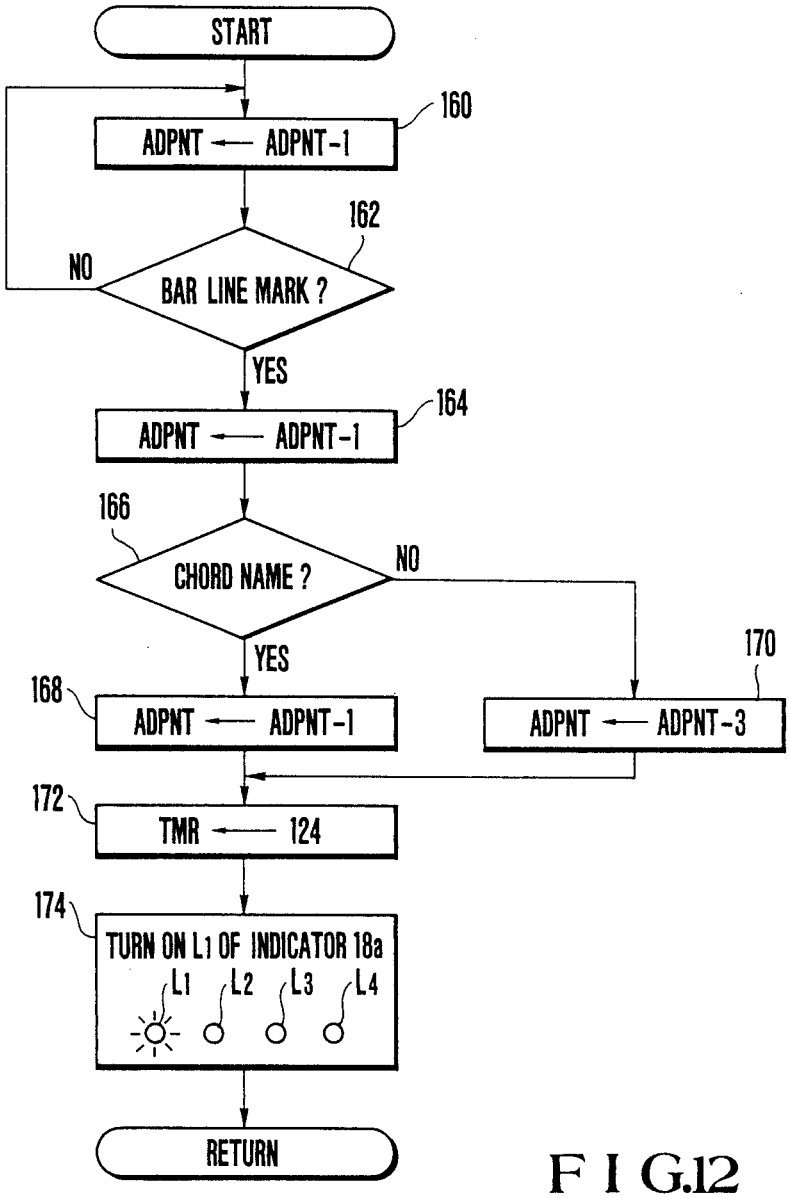
FIG. 12 is a flow chart of a subroutine of edit processing.

Subroutine of Edit Processing (FIG. 12)

In a subroutine of edit processing shown in FIG. 12, a value of the pointer ADPNT is decremented by one in step 160. When the routine of FIG. 12 begins, the pointer ADPNT designates an address of timing data. Therefore, when the address is decremented by one, an address of data before the timing data is designated.

Then, in step 162, the CPU 20 checks whether the data designated by the pointer ADPNT is bar line mark data. If N in step 160, the above processing is repeatedly executed.

If Y is originally obtained in step 162 or Y is obtained in step 162 as a result of repetition of the above processing, the flow advances to step 164, and the value of the pointer ADPNT is decremented by one. This processing is executed to check data before the bar line mark data. Then, the flow advances to step 166.

In step 166, the CPU 20 checks whether the data whose address is designated by the pointer ADPNT is chord name data. If Y in step 166, the flow advances to step 168, and the value of the pointer ADPNT is decremented by one. As a result, the pointer ADPNT designates an address of timing data of the data shown in the data map (D) of FIG. 5.

If N in step 166, this means that the designated data is the fourth byte of the data shown in the data map (E) of FIG. 5, and the flow advances to step 170.

In step 170, the value of the pointer ADPNT is decremented by three. As a result, an address of timing data of the data shown in the data map (E) of FIG. 5 is designated.

After step 168 or 170, timing value=124 which corresponds to the head of a measure is set in step 172. Then, the flow advances to step 174, and the light-emitting element L1 of the indicator **18*a*** is turned on to indicate that this is the first beat. Thereafter, the flow returns to the routine of FIG. 7.

In the processing sequence shown in FIG. 12, a reinput operation can be performed from the start of a measure.

Figure 13:
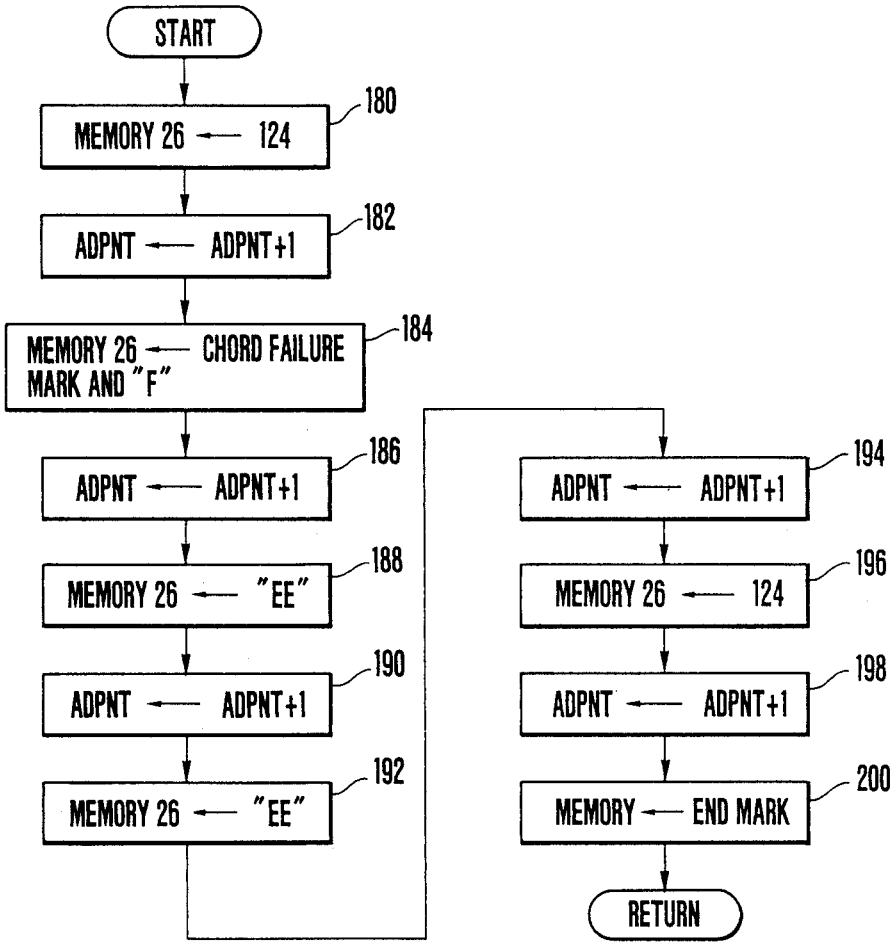
FIG. 13 is a flow chart of a subroutine of end processing.

Subroutine of End Processing (FIG. 13)

In a subroutine of end processing shown in FIG. 13, timing value=124 is written in the memory 26 in step 180.

Then, a value of the pointer ADPNT is incremented by one in step 182, and the flow advances to step 184. In step 184, chord failure mark data and 1-byte data consisting of data (which represents no fundamental note) of "F" in hexadecimal notation is written in the memory 26. Then, the flow advances to step 186.

In step 186, the value of the pointer ADPNT is incremented by one. Then, the flow advances to step 188, and data (which represents no key-on for two keys) of "EE" in hexadecimal notation is written in the memory 26. Thereafter, the value of the pointer ADPNT is incremented by one in step 190, and the flow advances to step 192. In step 192, the data of "EE" is written in the memory 26 as in step 188.

With the processing executed so far, the rest designation data RD shown in FIG. 5 is written in the memory 26.

Thereafter, the value of the pointer ADPNT is incremented by one in step 194, and the flow advances to step 196. In step 196, timing value=124 is written in the memory 26. Then, the value of the pointer ADPNT is incremented by one in step 198, the flow advances to step 200, and end mark data is written in the memory 26. As a result, the end data ED shown in FIG. 5 is written in the memory 26.

After step 200, the flow returns to the routine of FIG. 7.

Note that since the play processing can be easily practiced in accordance with a conventional technique, a detailed description thereof will be omitted and only an example thereof will be briefly described below.

That is, a tempo counter which executes an operation for obtaining a count of 0 to 127 in one measure by counting tempo clock signals repeatedly in a period corresponding to one measure is provided. In addition, data as shown in the data maps (A) to (E) of FIG. 5 are sequentially read out from the memory 26 in the order they were written. In this case, the data of the data maps (A) to (C) are set in corresponding controllers. As for the data of the data map (D) or (E), each time the data is read out from the memory 26, a musical tone corresponding to the readout musical tone data (chord name data or key data) is generated at a timing at which the count of the tempo counter is 0 if a value of timing data in the readout data is 124, at a timing of 32 if the value is 28, at a timing of 64 if the value is 60, and at a timing of 96 if the value is 92, respectively. Note that when the readout data of the data map (E) corresponds to a rest such as the RD in FIG. 5, generation of a musical tone is stopped.

Modifications

The present invention is not limited to the above embodiment but can be practiced in a variety of modified forms. For example, the following modifications can be made.

(1) In the above embodiment, chord information is recorded/played. However, the present invention can be applied to a case wherein other performance information such as a melody, a base, or an arpeggio is to be recorded/played.

(2) An input operation need not be returned to the head of a measure but may be returned to that of a phrase. A phrase is a unit determined for each composition and includes two or more notes.

(3) In the above embodiment, performance information is written in the memory by operating a key and a note switch, i.e., by step write input. However, the present invention can be applied to a case wherein performance information is to be written in a memory in real time in response to a key operation.

As has been described above, according to the present invention, when an incorrect input occurs, an input operation is returned to the head of a performance section and performance information is reinput therefrom. Therefore, an automatic performance apparatus in which an incorrect input can be corrected more easily than in a conventional apparatus and which can be easily used can be realized.

What is claimed is:

1. An automatic performance apparatus for an electronic musical instrument, comprising:

input means for inputting music performance information;

a memory device having a plurality of addresses for storing music performance information input by the input means in plural music performance units of certain length each having not less than two notes;

write means for sequentially writing music performance information at the addresses of said memory device on the basis of an operation of said input means, wherein music performance information is written in said memory device to designate a start point for each music performance unit;

switching means for commanding rewriting; and write control means, responsive to a command from said switching means, for returning said memory device to the start point of a predetermined music performance unit in accordance with music performance information written in said memory device designating said start point of said predetermined music performance unit.

2. An apparatus according to claim 1, wherein said start point is the head of a music performance unit for which music performance information is just being written.

3. An apparatus according to claim 2, wherein said music performance unit is a measure.

4. An apparatus according to claim 2, wherein said music performance unit is a musical phrase.

5. An apparatus according to claim 3, wherein said write means writes start point data of each measure at an address next to that of a first note datum of each measure in said memory device.

6. An apparatus according to claim 3, wherein said write means writes rest designation data and end data at the end of the music performance information to be written in said memory device.

* * * * *